US007483654B2

(12) United States Patent
Hosoya et al.

(10) Patent No.: US 7,483,654 B2
(45) Date of Patent: Jan. 27, 2009

(54) WET TYPE IMAGE FORMATION APPARATUS AND LIQUID DEVELOPING AGENT CLEANER THEREFOR

(75) Inventors: Masahiro Hosoya, Saitama (JP); Hideki Nukada, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 52 days.

(21) Appl. No.: 11/188,906

(22) Filed: Jul. 26, 2005

(65) Prior Publication Data

US 2006/0029430 A1 Feb. 9, 2006

(30) Foreign Application Priority Data

Aug. 6, 2004 (JP) ..... 2004-230076

(51) Int. Cl.
*G03G 15/10* (2006.01)
*G03G 21/00* (2006.01)

(52) U.S. Cl. ..... 399/249; 399/350

(58) Field of Classification Search ..... 399/237, 399/249, 348–350, 357, 358
See application file for complete search history.

(56) References Cited

U.S. PATENT DOCUMENTS 6,215,972 B1 * 4/2001 An et al. ..... 399/249

FOREIGN PATENT DOCUMENTS

| | | |
|---|---|---|
| JP | 58-72981 | 5/1983 |
| JP | 62-161261 | 10/1987 |
| JP | 7-302028 | 11/1995 |
| JP | 11-231660 | 8/1999 |
| JP | 11-327312 | 11/1999 |
| JP | 2001-242716 | 9/2001 |
| JP | 2002-287517 | 10/2002 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A side face excluding the edge of a squeegee cleaner made of a plate-shaped urethane rubber is brought into pressure contact with a squeeze roller. Even for long-term use, a pressure contact surface of the squeegee cleaner does not break and long life of the squeegee cleaner is obtained and good cleaning performance is maintained and a liquid developing agent of a surface of the squeeze roller is surely removed.

18 Claims, 13 Drawing Sheets

WET TYPE IMAGE FORMATION APPARATUS AND LIQUID DEVELOPING AGENT CLEANER THEREFOR

CROSS-REFERENCE TO RELATED APPLICATION

This application is based upon and claims the benefit of priority from the prior Japanese Patent Application No. 2004-230076, filed on Aug. 6, 2004; the entire contents of which are incorporated herein by reference.

BACKGROUND OF THE INVENTION

1. Field of the Invention

The present invention relates to a wet type image formation apparatus for forming a toner image using a liquid developing agent, and a liquid developing agent cleaner.

2. Description of the Related Art

A wet type image formation apparatus for obtaining a toner image using a liquid developing agent configured by toner particles and a carrier solvent has advantages that high image quality can be achieved since very fine toner particles with a submicron size can be used, that texture equivalent to printing (for example, offset printing) can be achieved in addition to economy since a sufficient image density can be obtained by a small amount of toner, and further that energy saving can be achieved since toner can be fixed on paper at a relatively low temperature, etc.

In such a wet type image formation apparatus, it is necessary to scrape a surplus liquid developing agent on a photoconductor after a liquid developing agent is supplied to the photoconductor in order to prevent a fog of a toner image and improve transfer efficiency as well as efficiency of a dry process. For this purpose, there is conventionally an apparatus for disposing a squeeze device for removing a surplus liquid developing agent on a photoconductor after development (for example, see JP-A-7-302028 (Pages 3 and 4, FIGS. 1 and 2))

In JP-A-7-302028, after development by a developing roller, a surplus liquid developing agent adhering to a photoconductor drum is removed by a squeeze roller and further an edge of a blade made of urethane rubber and mylar with a high hardness are sequentially abutted on the squeeze roller and an angular portion of fastened toner on a surface of the squeeze roller is shaved by the mylar and then the liquid developing agent is removed by the blade.

However, in JP-A-7-302028, a structure using both of the mylar and the blade is adopted and the fastened toner is shaved to a certain extent by the mylar but the blade for removal of the liquid developing agent is configured by its edge abutted on the squeeze roller. In addition, the blade tends to cause breakage by suffering chemical degradation due to a carrier solvent and has low durability. As a result of this, even when the angular portion of the fastened toner is previously shaved using the mylar, the edge portion of the blade tends to break and when the edge breaks in long-term use, there was a problem that the liquid developing agent on the surface of the squeeze roller by the blade is insufficiently removed or unevenness of removal occurs thereby causing defects in an image.

SUMMARY OF THE INVENTION

As described above, in the related art, there was a problem that in long-term use, a blade abutting on a surface of a roller-shaped or belt-shaped movable body for transporting a liquid developing agent has low durability and the edge portion of the blade breaks and the liquid developing agent is insufficiently removed or unevenness of removal occurs thereby causing reduction in image quality.

It is an object of the invention to provide a wet type image formation apparatus in which while a structure is simple, even in long-term use in a state of being exposed to a liquid developing agent, a portion abutting on a surface of a movable body is prevented from breaking to achieve long life and the liquid developing agent on the surface of the movable body is removed well over the long term and thus an image of high grade by high cleaning performance can be obtained over the long term, and a liquid developing agent cleaner.

According to one aspect of the invention, there is provided with a wet type image formation apparatus including: an image carrier; a developing device forming a visible image on the image carrier by applying a liquid developing agent having a carrier solvent and a solid component to an electrostatic latent image formed on the image carrier; a squeeze member being movable in contact with the liquid developing agent in order to remove a portion of the carrier solvent from the visible image; a liquid developing agent cleaner having a plate-shaped elastic body including a first part having a first curvature radius and a second part being adjacent to the first part, the second part having a second curvature radius smaller than the first curvature radius of the first part, the liquid developing agent cleaner removing the liquid developing agent from a surface of the squeeze member by bringing the first part of the plate-shaped elastic body into pressure contact with the squeeze member, and a transfer device transferring the visible image on the image carrier after passing through the squeeze member to a transfer material.

According to another aspect of the invention, there is provided with a wet type image formation apparatus including: an image carrier; a developing device forming a visible image on the image carrier by applying a liquid developing agent having a carrier solvent and a solid component to an electrostatic latent image formed on the image carrier; a squeeze member being movable in contact with the liquid developing agent in order to remove a portion of the carrier solvent from the visible image; a liquid developing agent cleaner joining an elastic body chip to a support plate, the liquid developing agent cleaner removing the liquid developing agent from a surface of the squeeze member by bringing the elastic body chip into pressure contact with the squeeze member, and a transfer device transferring the visible image on the image carrier after passing through the squeeze member to a transfer material.

According to another aspect of the invention, there is provided with a wet type image formation apparatus including: an image carrier; a developing device forming a visible image on the image carrier by applying a liquid developing agent having a carrier solvent and a solid component to an electrostatic latent image formed on the image carrier; a squeeze member being movable in contact with the liquid developing agent in order to remove a portion of the carrier solvent from the visible image; a liquid developing agent cleaner having an elastic body roller, the liquid developing agent cleaner removing the liquid developing agent from a surface of the squeeze member by bringing the elastic body roller into pressure contact with the squeeze member, and a transfer device transferring the visible image on the image carrier after passing through the squeeze member to a transfer material.

According to another aspect of the invention, there is provided with a liquid developing agent cleaner for removing a liquid developing agent from a surface of a liquid developing agent carrier by making contact with the liquid developing agent carrier for carrying the liquid developing agent having a carrier solvent and a solid component, the liquid developing agent cleaner including: a plate-shaped elastic body having: a first part having a first curvature radius; and a second part being adjacent to the first part and having a second curvature radius smaller than the first curvature radius of the first part. The first part of the plate-shaped elastic body is brought into pressure contact with the liquid developing agent carrier.

According to embodiments of the invention, by a simple apparatus configuration, a portion abutting on a surface of a movable body can be prevented from breaking over the long term, so that long life of a liquid developing agent cleaner can be achieved. Therefore, the liquid developing agent cleaner can surely remove a liquid developing agent on the surface of the movable body for the long term, and a wet type image formation apparatus for outputting an image of high grade and having high cleaning performance over the long term can be obtained.

DETAILED DESCRIPTION OF THE EMBODIMENTS

According to embodiments of the invention, an apparatus in which a cleaner is brought into contact with a squeeze roller or a cleaning roller and the cleaner is prevented from breaking and a liquid developing agent on a surface of the squeeze roller or the cleaning roller is surely removed over the long term.

First Embodiment

Figure 1:
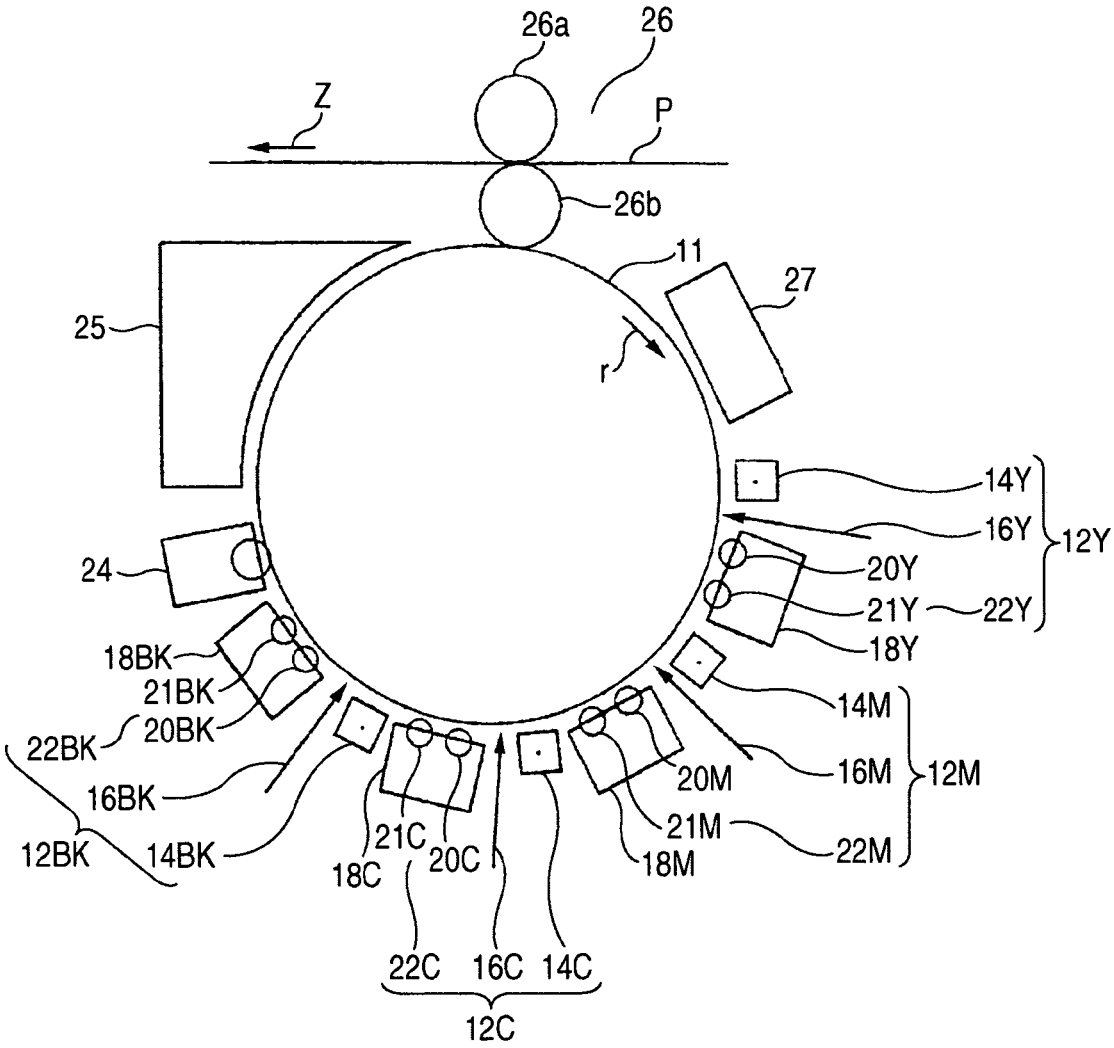
FIG. 1 is a schematic configuration diagram showing a main part of a color image formation apparatus of a first embodiment of the invention.

A first embodiment of the invention will be described below using FIGS. 1 to 4. FIG. 1 shows a main part of a wet type color image formation apparatus 10 which is a wet type image formation apparatus. The color image formation apparatus 10 has a photoconductor drum 11 which is an image carrier in which a photoconductive layer of an organic system or an amorphous silicon system is disposed on a conductive substrate such as aluminum. In the periphery of the photoconductor drum 11, image formation units 12Y, 12M, 12C, 12BK which are first to fourth toner image formation parts for forming toner images which are visible images using each of the liquid developing agents of yellow (Y), magenta (M), cyan (C), black (BK) made by dispersing a carrier solvent and toner particles which are solid components are sequentially arranged on the photoconductor drum 11 along rotation of a direction of arrow of the photoconductor drum 11.

The carrier solvent is made of a well-known petroleum insulation solvent, etc. The toner particles are formed by adding colorant and an electrification control agent, etc. to thermoplastic resin having a predetermined glass transition point and in the present embodiment, the particle has an average particle diameter of 0.7 μm. The image formation unit 12Y of yellow (Y) has an electrification device 14Y made of a well-known corona electrification device or Scorotoron electrification device, etc. for uniformly electrifying a surface of the photoconductor drum 11, and the photoconductor drum 11 is selectively irradiated with a laser beam 16Y of yellow (Y) in which image modulation is performed according to a light signal of yellow (Y) from a laser emitting device (not shown). Further, the image formation unit 12Y of yellow (Y) has a yellow (Y) developing device 22Y which receives a liquid developing agent 18Y of yellow (Y) and comprises a developing roller 20Y for supplying the liquid developing agent 18Y to the photoconductor drum 11 and imaging an electrostatic latent image and forming a toner image of yellow (Y) on the photoconductor drum 11 and a squeeze roller 21Y which is a squeeze member for simultaneously removing the carrier solvent and a fog of the toner image after development.

Each of the downstream image formation units 12M to 12BK of magenta (M), cyan (C), black (BK) is constructed in a manner similar to the image formation unit 12Y of yellow (Y) arranged upstream though colors of the liquid developing agents are respectively different.

A liquid suction squeezing device 24 having a liquid suction roller 134 for improving strength of adhesion of the toner particles to the side of the photoconductor drum 11 while sucking the carrier solvent is disposed in the down stream portion of the black image formation unit 12BK of the periphery of the photoconductor drum 11. A drying device 25 for drying a toner image is disposed in the downstream portion of the liquid suction squeezing device 24.

A transfer device 26 which has an intermediate transfer roller 26*b* brought into pressure contact with the photoconductor drum 11 by a pressurizing roller 26*a* and primarily transfers a toner image formed on the photoconductor drum 11 to the intermediate transfer roller 26*b* and then secondarily transfers the toner image to paper P etc., and further a photoconductor cleaning device 27 for removing the toner particles remaining on the photoconductor drum 11 after the transfer are disposed in the downstream portion of the drying device 25.

Figure 2:
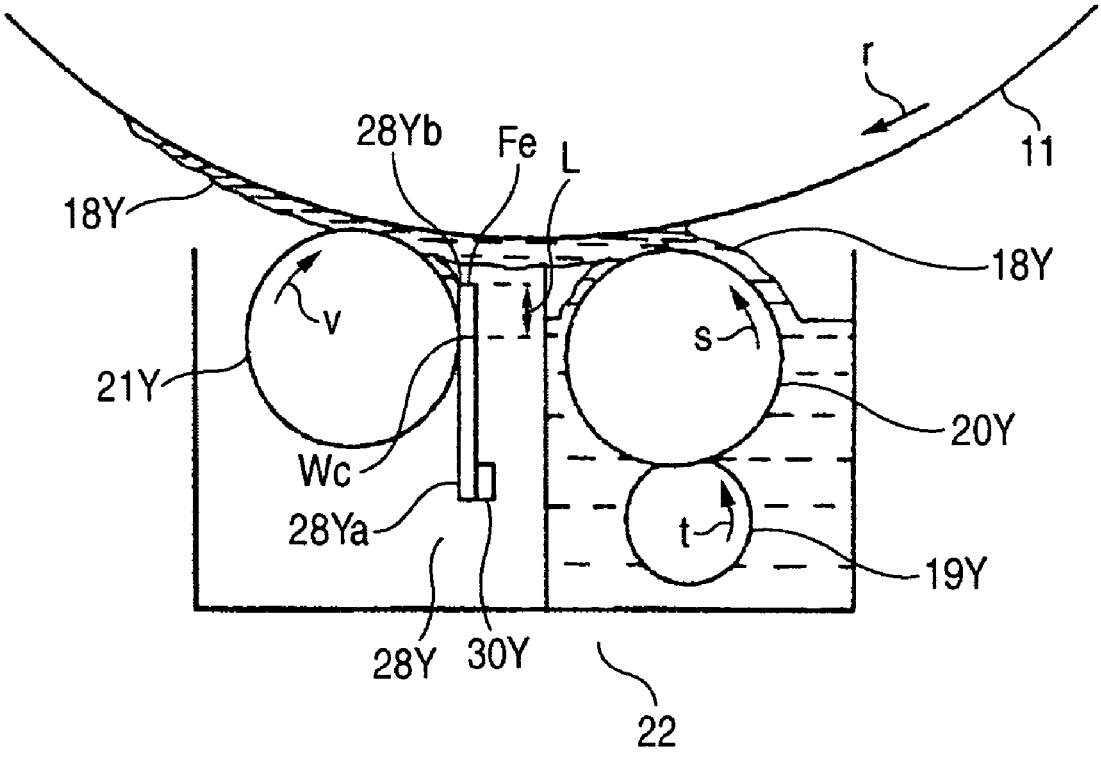
FIG. 2 is a schematic configuration diagram showing a developing device of the first embodiment of the invention.

Next, the developing device 22Y will be described in detail. As shown in FIG. 2, the developing roller 20Y arranged as opposed to the photoconductor drum 11 rotates in a direction of arrow s moving according to rotation of the photoconductor drum 11. The liquid developing agent 18Y is supplied to photoconductor drum 11 with rotation of the direction of arrow s of the developing roller 20Y. A foam roller 19Y for removing the toner particles adhering to a surface of the developing roller 20Y is in contact with the developing roller 20Y so as to rotate in a direction of arrow t.

The squeeze roller 21Y disposed in the downstream portion of the developing roller 20Y is configured by, for example, a stainless roller, and is arranged through a slight gap of 30 to 70 μm with respect to a surface of the photoconductor drum 11, and moves and rotates in a direction of arrow v opposite to a direction of the photo conductor drum 11 in a position opposed to the photoconductor drum 11 at high speed. Also, a voltage of the same polarity as that of the toner particles is applied to the squeeze roller 21Y and by this voltage, the toner particles adhering to an electrostatic latent image of the surface of the photoconductor drum 11 is pushed to the side of the photoconductor drum 11 by electrophoresis and a toner image is set and a fog is removed. Further, a squeegee cleaner 28Y for removing the liquid developing agent is abutted on a surface of the squeeze roller 21Y after passing through a position opposed to the photoconductor drum 11.

The squeegee cleaner 28Y abutting on the squeeze roller 21Y is made of, for example, a plate-shaped urethane rubber which is a plate-shaped elastic body. The squeegee cleaner 28Y is formed so as to have a side face (first part) 28Ya and an edge (second part) 28Yb adjacent to the side face in a state in which the squeegee cleaner does not abut on the squeeze roller 21Y. The side face 28Ya has a curvature radius larger than that of the edge 28Yb under no load. The side face 28Ya may be, for example, a plane (a curvature radius is infinity) and may also be a curved surface. The side face excluding the edge is supported by a holder 30Y so as to be brought into pressure contact with the squeeze roller 21Y. A distance L from the center Wc of width of contact between the squeeze roller 21Y and the side face 28Ya of the squeegee cleaner to the free end Fe of the squeegee cleaner 28Y could be in the range from 0.2 mm to 4 mm. Also, a contact pressure (line pressure) of the squeegee cleaner side face 28Ya with the squeeze roller 21Y could be 10 g/cm to 400 g/cm per length of a direction perpendicular to a direction of movement of the surface of the squeeze roller 21Y.

When such setting is made, the liquid developing agent 18Y of the surface of the squeeze roller 21Y squeezed in a position of contact with the photoconductor drum 11 is pressurized in a position of contact with the squeegee cleaner side face 28Ya and passage between the squeeze roller 21Y and the squeegee cleaner 28Y is blocked. As a result of this, the liquid developing agent is surely removed from the surface of the squeeze roller 21Y. It is constructed so that the liquid developing agent 18Y whose passage is blocked gets over the free end Fe of the squeegee cleaner 28Y and is dropped into the developing device 22Y and is refluxed to a toner tank (not shown).

In order to prevent the liquid developing agent 18Y from passing between the squeeze roller 21Y and the squeegee cleaner 28Y more surely, it is more preferable to set the contact pressure of the squeegee cleaner side face 28Ya with respect to the squeeze roller 21Y at 40 g/cm to 200 g/cm per length of a direction perpendicular to a direction of movement of the surface of the squeeze roller 21Y. Also, in order to cause the liquid developing agent 18Y to get over the free end Fe of the squeegee cleaner 28Y and drop the liquid developing agent 18Y into the developing device 22Y more easily, it is more desirable to set the distance L from the center Wc of width of contact between the squeeze roller 21Y and the squeegee cleaner side face 28Ya to the free end Fe of the squeegee cleaner 28Y in the range from 0.5 mm to 1.5 mm.

A rubber hardness of the plate-shaped urethane rubber may be preferably in the range of 20 to 80. When the rubber hardness is less than 20, there is fear that the plate-shaped urethane rubber cannot withstand pressure of the liquid developing agent 18Y attempting to pass under pressure of the squeegee cleaner 28Y and the liquid developing agent is partially passed to cause a cleaning failure. On the other hand, when the rubber hardness exceeds 80, there is fear that variations in processing accuracy of rubber cannot be absorbed by elastic deformation to cause a cleaning failure partially.

For example, the plate-like elastic member using for the squeegee cleaner 28 Y maybe a polymeric film having a thickness which is approximately ranged from 50 micrometer to 200 micrometer. The polymeric film may be polyester film, nylon film, acrylic film, polyimide film, and fluorocarbon polymer film. The plate-like metallic member having a thickness which is approximately ranged from 0.05 mm to 0.3 mm is also applied to the squeegee cleaner 28Y. For example, the plate-like metallic member may be a phosphor bronze, and stainless.

Each of the developing devices 22M to 22BK of magenta (M), cyan (C), black (BK) is constructed in a manner similar to the developing device 22Y of yellow (Y) though colors of the liquid developing agents 18M to 18BK are respectively different.

Figure 3:
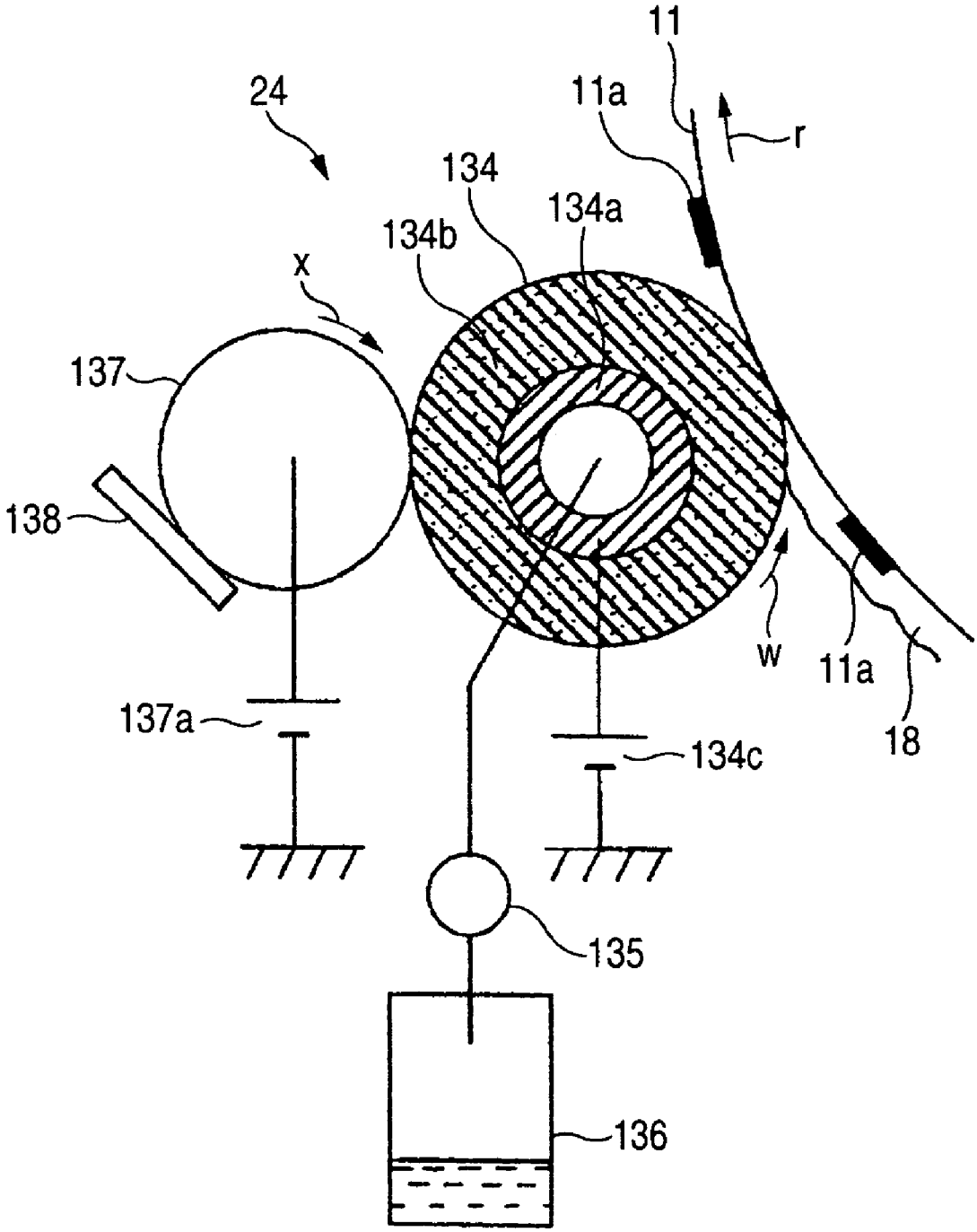
FIG. 3 is a schematic configuration diagram showing a liquid suction squeezing device of the first embodiment of the invention.

Next, the liquid suction squeezing device 24 will be described in detail with reference to FIG. 3. The liquid suction roller 134 of the liquid suction squeezing device 24 is formed by covering a hollow core 134*a* with a conductive foam roller 134*b* and a voltage of the same polarity as that of toner particles is applied so as to repulse the toner particles by a power source 134*c*. The liquid suction roller 134 makes slight contact with the photoconductor drum 11 and rotates in a direction of arrow w at the same circumferential speed as that of the photoconductor drum 11. Also, the liquid suction roller 134 is sucked by a suction pump 135 through the hollow core 134*a* in order to recover the absorbed carrier solvent to a tank 136.

Further, a portion of the toner particles constructing a toner image 11*a* on the photoconductor drum 11 inevitably adhere to the liquid suction roller 134, so that a cleaning roller 137 for rotating in a direction of arrow x removing this portion of the toner particles is brought into contact with the liquid suction roller 134. A voltage for promoting cleaning is applied to the cleaning roller 137 by a power source 137*a*. A blade 138 which is a liquid developing agent cleaner is abutted on a surface of the cleaning roller 137. The blade 138 can remove the liquid developing agent from the surface of the cleaning roller 137 by bringing a side face excluding the edge of, for example, a plate-shaped urethane rubber into pressure contact with the cleaning roller 137 in a manner similar to the squeegee cleaner 28Y described above.

Figure 4:
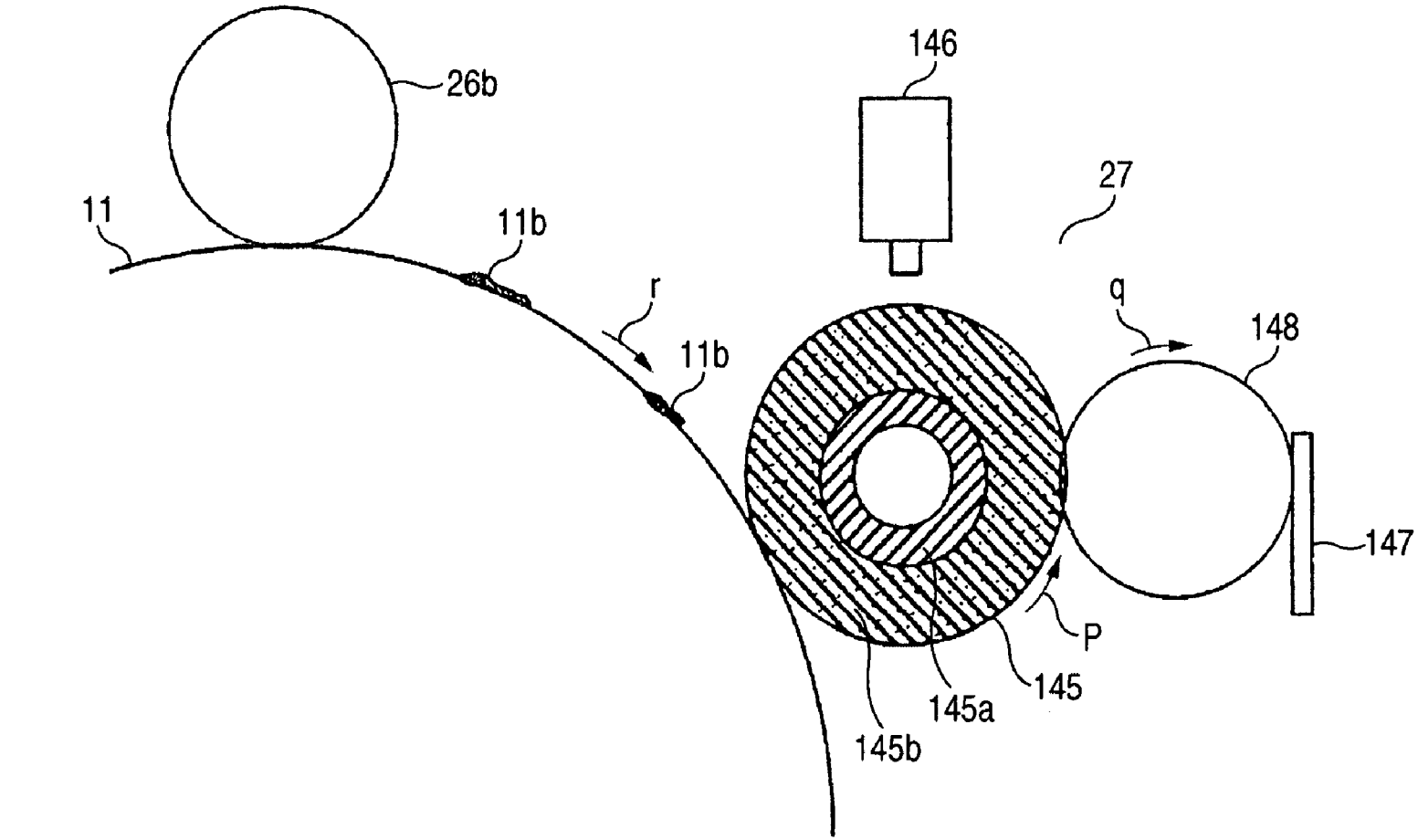
FIG. 4 is a schematic configuration diagram showing a photoconductor cleaning device of the first embodiment of the invention.

Next, the photoconductor cleaning device 27 will be described in detail with reference to FIG. 4. The photoconductor cleaning device 27 has a cleaning roller 145 for making contact with the photoconductor drum 11 and absorbing the transfer residual toner 11*b*, and a liquid supply device 146 for supplying the carrier solvent to the cleaning roller 145 in order to improve cleaning performance. The cleaning roller 145 is formed by covering a hollow core 145*a* sucked by a suction pump (not shown) with a conductive foam roller 145*b* and rotates in a direction of arrow p and a voltage for sucking toner particles is applied. A toner removal roller 148 for rotating in a direction of arrow q removing the adhering toner by electric field action etc. is brought into contact with a surface of the cleaning roller 145. A toner removal blade 147 which is a liquid developing agent cleaner is a butted on a surface of the toner removal roller 148. The toner removal blade 147 can remove the liquid developing agent from the surface of the toner removal roller 148 by bringing a side face excluding the edge of, for example, a plate-shaped urethane rubber into pressure contact with the toner removal roller 148 in a manner similar to the blade 138 or the squeegee cleaner 28Y described above.

Next, action will be described. With rotation of a direction of arrow r of the photoconductor drum 11 by a start of an image formation process, first, the photoconductor drum 11 is uniformly electrified by the electrification device 14Y in the image formation unit 12Y of yellow (Y) and then is selectively irradiated with the laser beam 16Y and an electrostatic latent image corresponding to an image of yellow (Y) is formed. Further, in the electrostatic latent image on the photoconductor drum 11, the liquid developing agent 18Y is supplied in a thickness of about 100 μm by the developing device 22Y and a toner image of yellow (Y) is formed.

Then, the toner image of the photoconductor drum 11 is squeezed into a liquid film with a thickness of several μm by setting the toner image by the squeeze roller 21Y and also removing the surplus liquid developing agent. The liquid developing agent 18Y of a surface of the squeeze roller 21Y is removed from the surface of the squeeze roller 21Y in a position of pressure contact with the squeegee cleaner 28Y. This is because a solid component adhering to the surface of the squeeze roller 21Y is easily sheared under pressure of the squeegee cleaner 28Y and both the solid component and the carrier solvent of the liquid developing agent are surely prevented from passing by the squeegee cleaner 28Y in contact with the squeeze roller 21Y. As a result of this, the surface of the squeeze roller 21Y enters in a position opposed to the photoconductor drum 11 with the liquid developing agent removed always and a thickness of a liquid film of the surplus liquid developing agent on the photoconductor drum 11 is adjusted well. The liquid developing agent 18Y removed from the surface of the squeeze roller 21Y gets over the free end Fe of the squeegee cleaner 28Y and is refluxed to a toner tank (not shown).

Subsequently, in like manner, a color toner image 11*a* made by sequentially superimposing toner images of magenta (M), cyan (C), black (BK) by the following image formation units 12M to 12BK and well adjusting a thickness of a liquid film of the surplus liquid developing agent is formed on the photoconductor drum 11.

Then, the color toner image 11*a* on the photoconductor drum 11 passes through the liquid suction squeezing device 24 and most of the carrier solvent is removed and the color toner image 11*a* is dried moderately by the drying device 25. Subsequently, the toner image 11*a* on the photoconductor drum 11 reaches the transfer device 26 and the toner image 11*a* is primarily transferred to the intermediate transfer roller 26b and is secondarily transferred to paper P transported in a direction of arrow z in FIG. 1 and a color image is completed on the paper P. After the completion of the transfer, the transfer residual toner 11*b* remaining on the photoconductor drum 11 is removed by the photoconductor cleaning device 27 and a series of the image formation processes is ended.

In the liquid suction squeezing device 24, a side face of the blade 138 is brought into pressure contact with a surface of the cleaning roller 137 in contact with the liquid suction roller 134 and in a manner similar to the squeegee cleaner 28Y described above, a liquid developing agent of the surface of the cleaning roller 137 is surely removed and cleaning performance of the cleaning roller 137 is well maintained.

In the photoconductor cleaning device 27, a side face of the toner removal blade 147 is brought into pressure contact with a surface of the toner removal roller 148 in contact with the cleaning roller 145 and in a manner similar to the blade 138 or the squeegee cleaner 28Y described above, a liquid developing agent of the surface of the toner removal roller 148 is surely removed and toner removal performance of the toner removal roller 148 is well maintained.

As a result of doing a durability test of image formation by this color image formation apparatus 10, in the conventional case of forming all of the liquid developing agent cleaner in pressure contact with the squeeze roller 21Y, the blade in pressure contact with the surface of the cleaning roller 137 and the toner removal blade 147 in pressure contact with the surface of the toner removal roller 148 by the same plate-shaped urethane rubber as the squeegee cleaner 28Y, the blade 138 and the toner removal blade 147 and abutting the edges, an image failure due to breakage of the edges occurred in continuous printing of about 30000 sheets of paper (A4-size paper).

On the other hand, in the case of removing the liquid developing agents from the squeeze roller 21Y, the cleaning roller 137 and the toner removal roller 148 using the side faces of the squeegee cleaner 28Y, the blade 138 and the toner removal blade 147 in the present embodiment, even in continuous printing of 100000 sheets of paper, breakage of pressure contact regions of the squeegee cleaner 28Y, the blade 138 and the toner removal blade 147 was not found and a cleaning failure was not found and it could be proved to have durability of at least 300000 sheets or more of paper.

Further, as a result of forming all of the squeegee cleaner 28Y in pressure contact with the squeeze roller 21Y, the blade 138 in pressure contact with the surface of the cleaning roller 137 and the toner removal blade 147 in pressure contact with the surface of the toner removal roller 148 by the same plate-shaped urethane rubber and changing curvature radii of the edges and performing test and comparison, in the case that the edge had a curvature radius smaller than 70 μm, that is, smaller than 100 times an average particle diameter (0.7 μm) of toner particles and this edge was abutted, it could be proved that an image failure due to breakage of the edge occurred in continuous printing of about 30000 sheets of paper (A4-size paper).

On the other hand, even for the edge having the curvature radius smaller than 70 μm, in the case of abutting a side face adjacent to the edge, it could be proved that breakage of the edge did not occur. Also, when a curvature radius of the edge is larger than or equal to 70 μm, even in the case of abutting the edge or the side face, it could be proved that breakage of the edge did-not occur.

By such a configuration, in the squeegee cleaner 28Y, the blade 138 or the toner removal blade 147, a portion having a curvature radius of 70 μm or larger is respectively in contact with the squeeze roller 21Y, the cleaning roller 137 or the toner removal roller 148, so that regardless of long-term use, the pressure contact surface is not broken and long life can be obtained and good cleaning performance is maintained over the long term. Therefore, the squeegee cleaner 28Y, the blade 138 or the toner removal blade 147 can surely remove the liquid developing agent of the surface of the squeeze roller 21Y, the cleaning roller 137 or the toner removal roller 148 over the long term to achieve an image output of high grade by the color image formation apparatus 10. Further, maintainability can be improved since frequency of replacement of the squeegee cleaner 28Y, the blade 138 or the toner removal blade 147 can be reduced.

Incidentally, the invention is not limited to the embodiment described above and various designs and modifications can be made and, for example, materials, shapes, structures or attachment positions, etc. of a liquid developing agent cleaner for removing a liquid developing agent of a surface of a movable body such as the squeeze roller 21Y, the cleaning roller 137 or the toner removal roller 148 in the embodiment described above are not limited at all as long as the liquid developing agent cleaner makes contact with the movable body.

Figure 5:
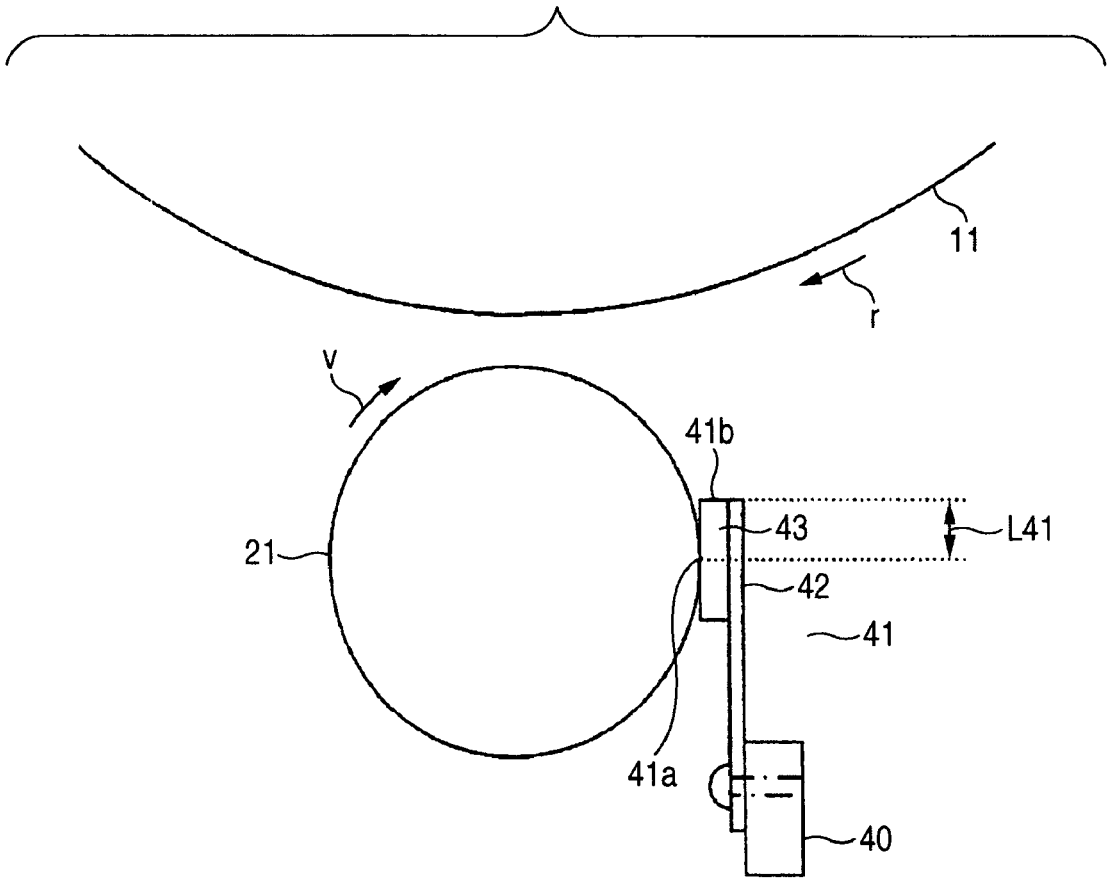
FIG. 5 is a schematic configuration diagram showing a liquid developing agent cleaner of a modified example 1 of the invention.
Figure 6:
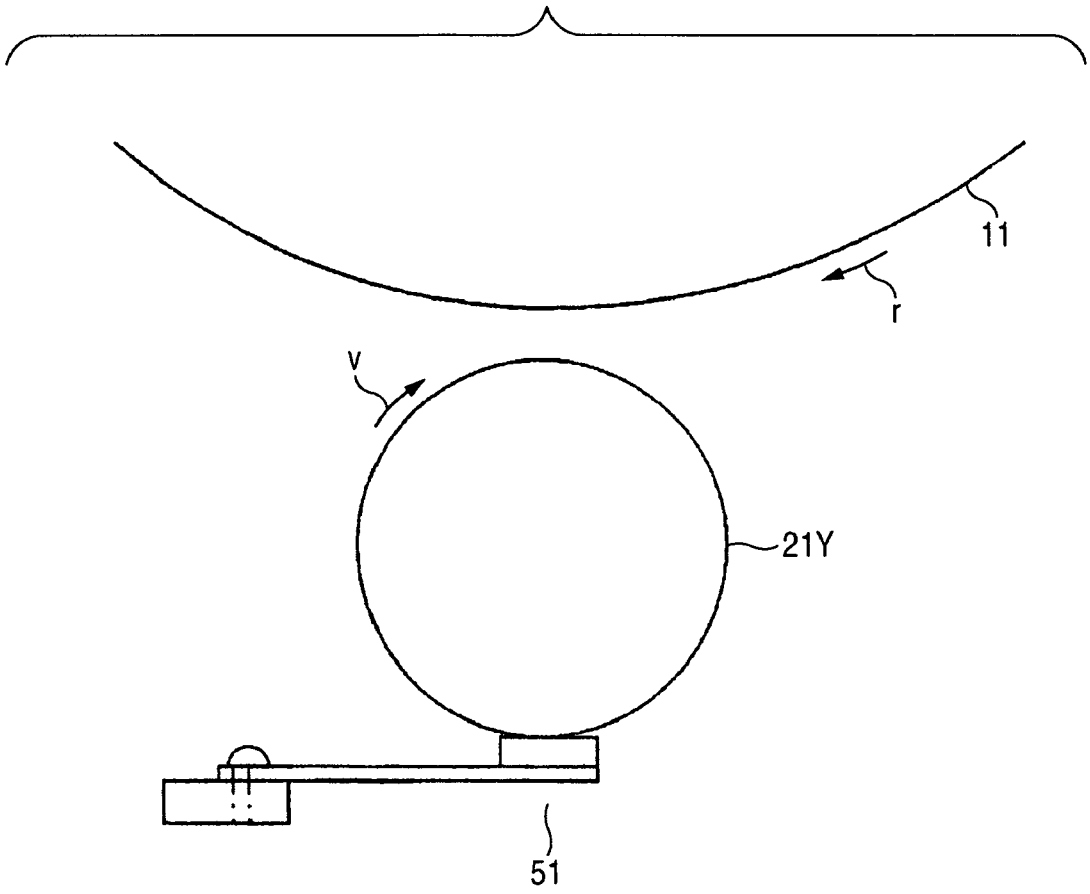
FIG. 6 is a schematic configuration diagram showing a liquid developing agent cleaner of a modified example 2 of the invention.

For example, a modified example 1 shown in FIG. 5 is an example in which a liquid developing agent cleaner 41 made by forming a plate-shaped urethane rubber 43 in a support plate 42 such as a metal plate or a resin plate detachably mounted in a holder 40 is abutted on a surface of the squeeze roller 21Y of the first embodiment described above as a liquid developing agent cleaner for removing a liquid developing agent. A distance L41 from the center 41*a* of width of contact between this squeeze roller 21Y and the liquid developing agent cleaner 41 to the free end 41*b* of the liquid developing agent cleaner 41 is preferably in the range from 0.2 mm to 4 mm in a manner similar to the first embodiment. A modified example 2 shown in FIG. 6 is an example in which a liquid developing agent cleaner 51 with the same structure as that of the liquid developing agent cleaner 41 of the modified example 1 is abutted on a lower portion of a squeeze roller 21Y.

Figure 7:
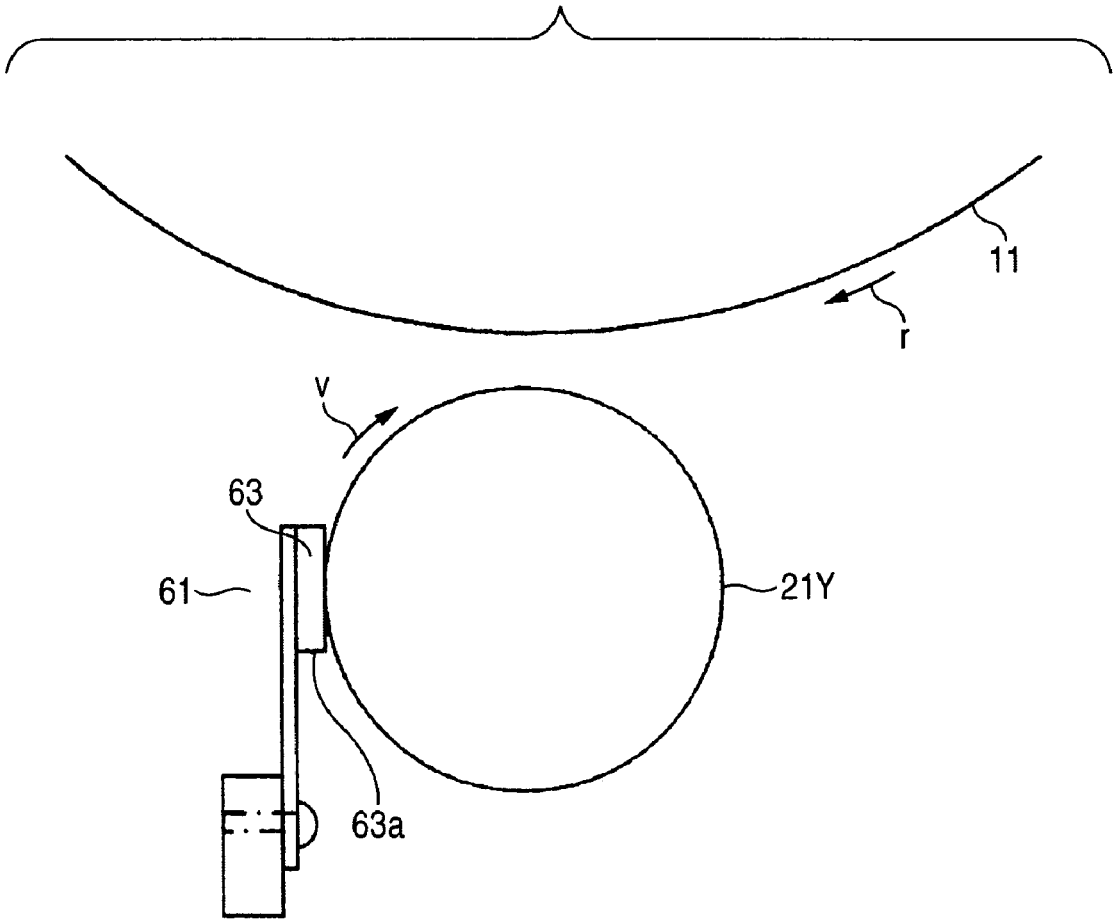
FIG. 7 is a schematic configuration diagram showing a liquid developing agent cleaner of a modified example 3 of the invention.
Figure 8:
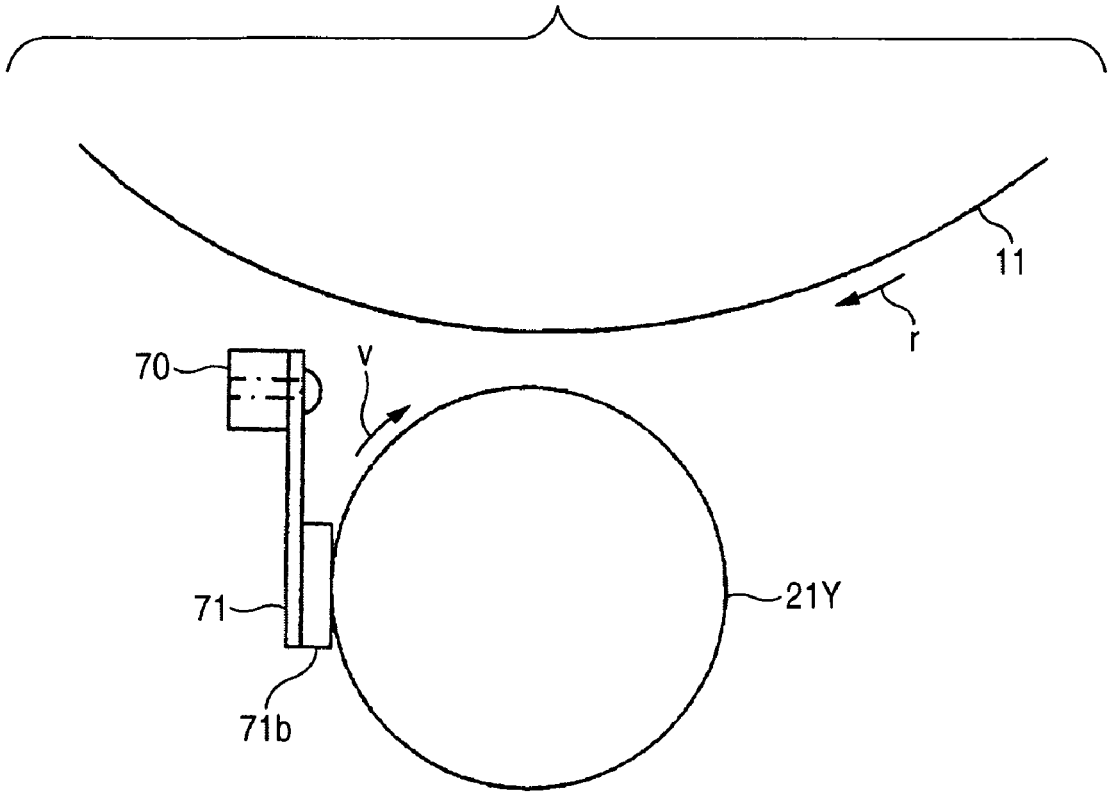
FIG. 8 is a schematic configuration diagram showing a liquid developing agent cleaner of a modified example 4 of the invention.

A modified example 3 shown in FIG. 7 is an example in which a liquid developing agent cleaner 61 with the same structure as that of the liquid developing agent cleaner 41 of the modified example 1 is abutted in a position of transporting a toner layer upward with rotation of a squeeze roller 21Y. A modified example 4 shown in FIG. 8 is an example in which a liquid developing agent cleaner 71 with the same structure as that of the liquid developing agent cleaner 61 of the modified example 3 is detachably mounted in a holder 70 in a position of the downstream side when viewed from a direction of rotation of a squeeze roller 21Y and is arranged so as to locate the free end 71*b* of the liquid developing agent cleaner 71 in the upstream side and is abutted on the squeeze roller 21Y.

According to this modified example 3 or modified example 4, a liquid developing agent of a surface of the squeeze roller 21Y is sheared by pressure contact force of the liquid developing agent cleaner 61 or the liquid developing agent cleaner 71 with respect to the squeeze roller 21Y and is surely prevented from passing by the liquid developing agent cleaner 61 or the liquid developing agent cleaner 71 in contact with the squeeze roller 21Y. Further, gravity is applied to the liquid developing agent and in the modified example 3, the liquid developing agent striking on the lower end 63*a* of a plate-shaped urethane rubber 63 is efficiently repelled and also in the modified example 4, the liquid developing agent striking on the free end 71*b* of the liquid developing agent cleaner 71 is efficiently repelled. Therefore, when the structure of the modified example 3 or the modified example 4 is adopted, the liquid developing agent can be removed more surely as compared with the modified example 1 or the modified example 2. Further, in the case of detachably mounting the liquid developing agent cleaner 71 in the holder 70 in an upward position of a developing device 22Y of the downstream side when viewed from a direction of rotation of the squeeze roller 21Y as shown in the modified example 4, replacement maintenance of the liquid developing agent cleaner 71 can be performed without touching the liquid developing agent and maintainability can be improved.

Figure 9:
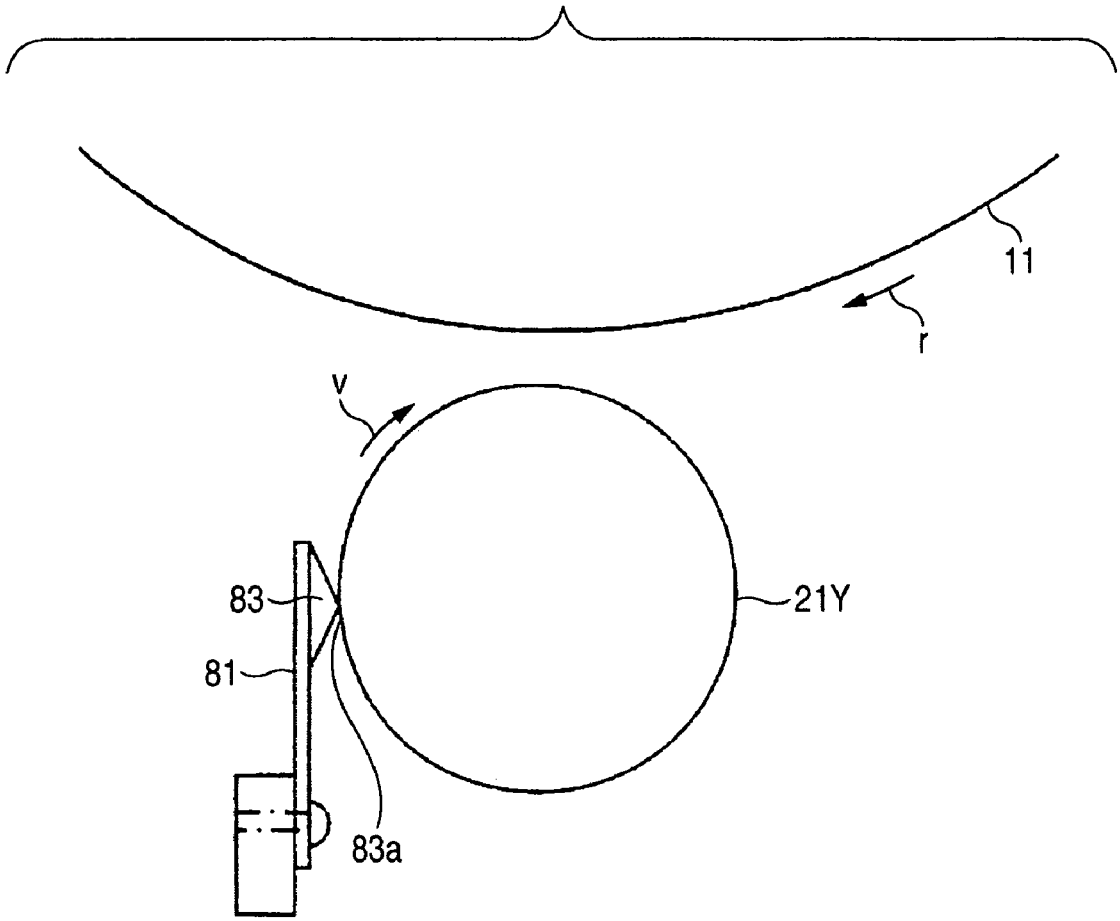
FIG. 9 is a schematic configuration diagram showing a liquid developing agent cleaner of a modified example 5 of the invention.

A modified example 5 shown in FIG. 9 is an example in which a liquid developing agent cleaner 81 in which the plate-shaped urethane rubber 63 of the liquid developing agent cleaner 61 of the modified example 3 is changed to a triangular chip 83 made of urethane rubber is used and an obtuse vertex 83*a* of the triangular chip 83 is abutted on a squeeze roller 21Y and the liquid developing agent cleaner 81 is brought into contact with the squeeze roller 21Y.

Figure 10:
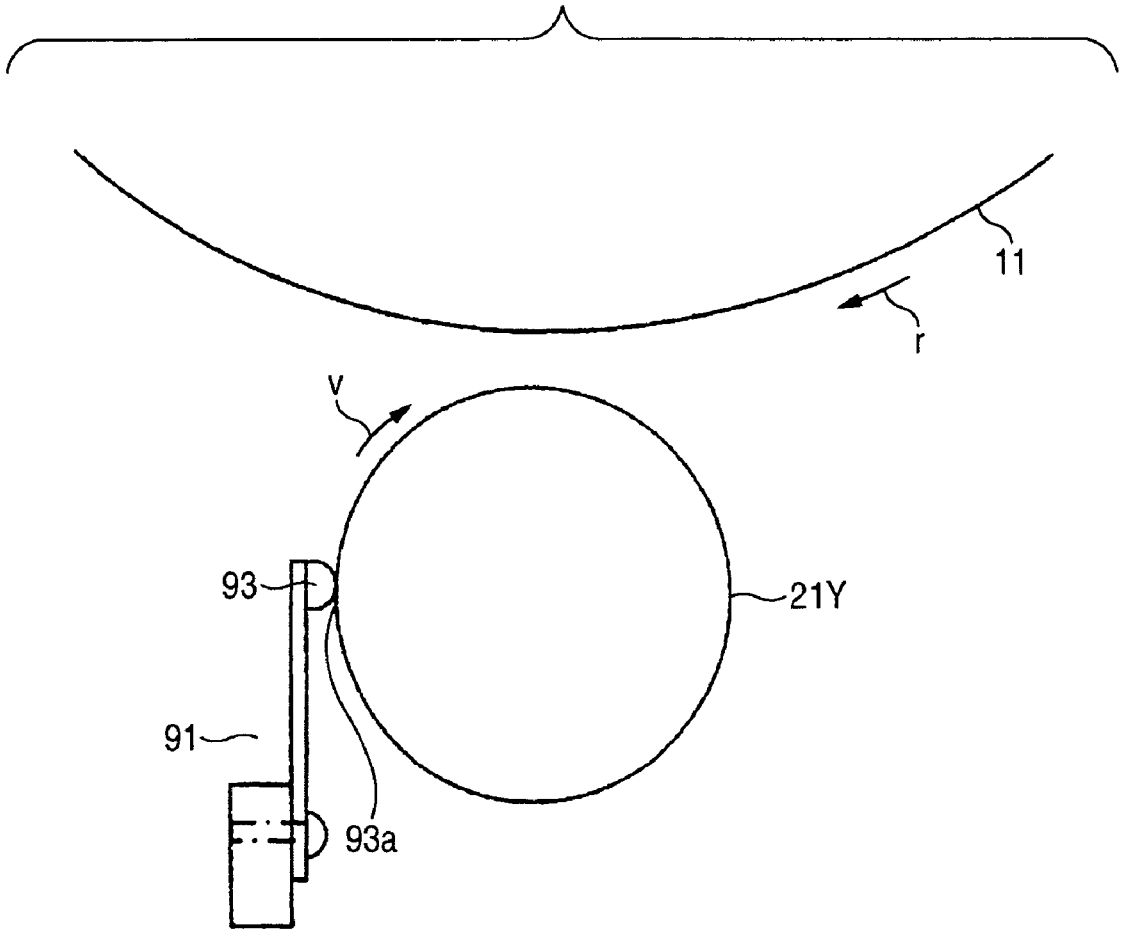
FIG. 10 is a schematic configuration diagram showing a liquid developing agent cleaner of a modified example 6 of the invention.

A modified example 6 shown in FIG. 10 is an example in which a liquid developing agent cleaner 91 in which the triangular chip 83 of the liquid developing agent cleaner 81 of the modified example 5 is changed to a hemispherical chip 93 is used and a vertex 93*a* of the hemispherical chip 93 is abutted on a squeeze roller 21Y and the liquid developing agent cleaner 81 is brought into contact with the squeeze roller 21Y.

According to this modified example 5 or modified example 6, the vertex of the triangular chip 83 or the chip 93 is respectively abutted on the squeeze roller 21Y, so that when the same pressure is applied, pressure contact force of the liquid developing agent cleaner 81 or the liquid developing agent cleaner 91 with respect to the squeeze roller 21Y in an abutment position becomes greater as compared with the case of the modified example 3 of abutting the plate-shaped urethane rubber. Therefore, when it is assumed that pressurizing force of each of the liquid developing agent cleaners is the same, the liquid developing agent in the modified example 5 or the modified example 6 can be removed more surely as compared with the modified example 3.

Figure 11:
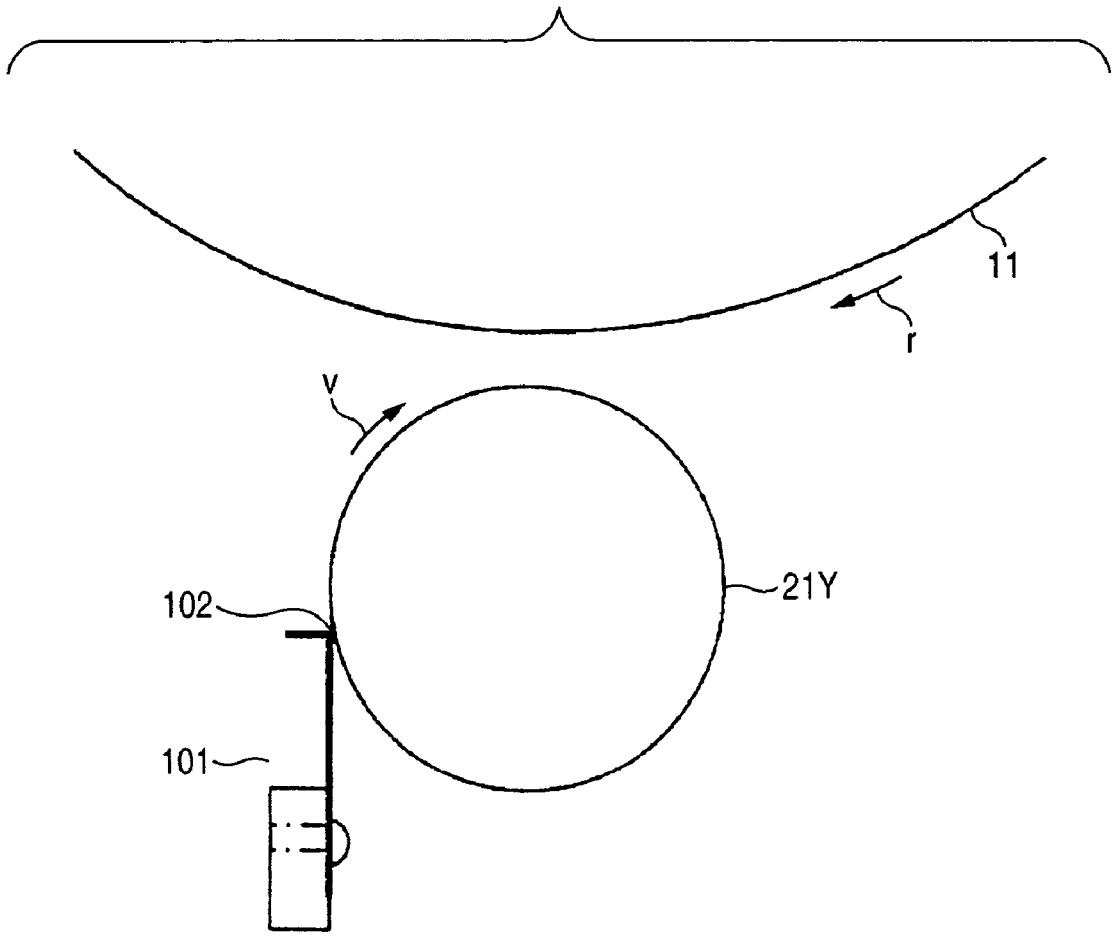
FIG. 11 is a schematic configuration diagram showing a liquid developing agent cleaner of a modified example 7 of the invention.

A modified example 7 shown in FIG. 11 is an example in which the liquid developing agent cleaner 61 of the modified example 3 is replaced with a liquid developing agent cleaner 101 made of an elastic metal plate in which the top is folded and a folded part 102 with a curvature radius larger than 100 times an average particle diameter of toner particles which are solid components is abutted on a squeeze roller 21Y.

Figure 12:
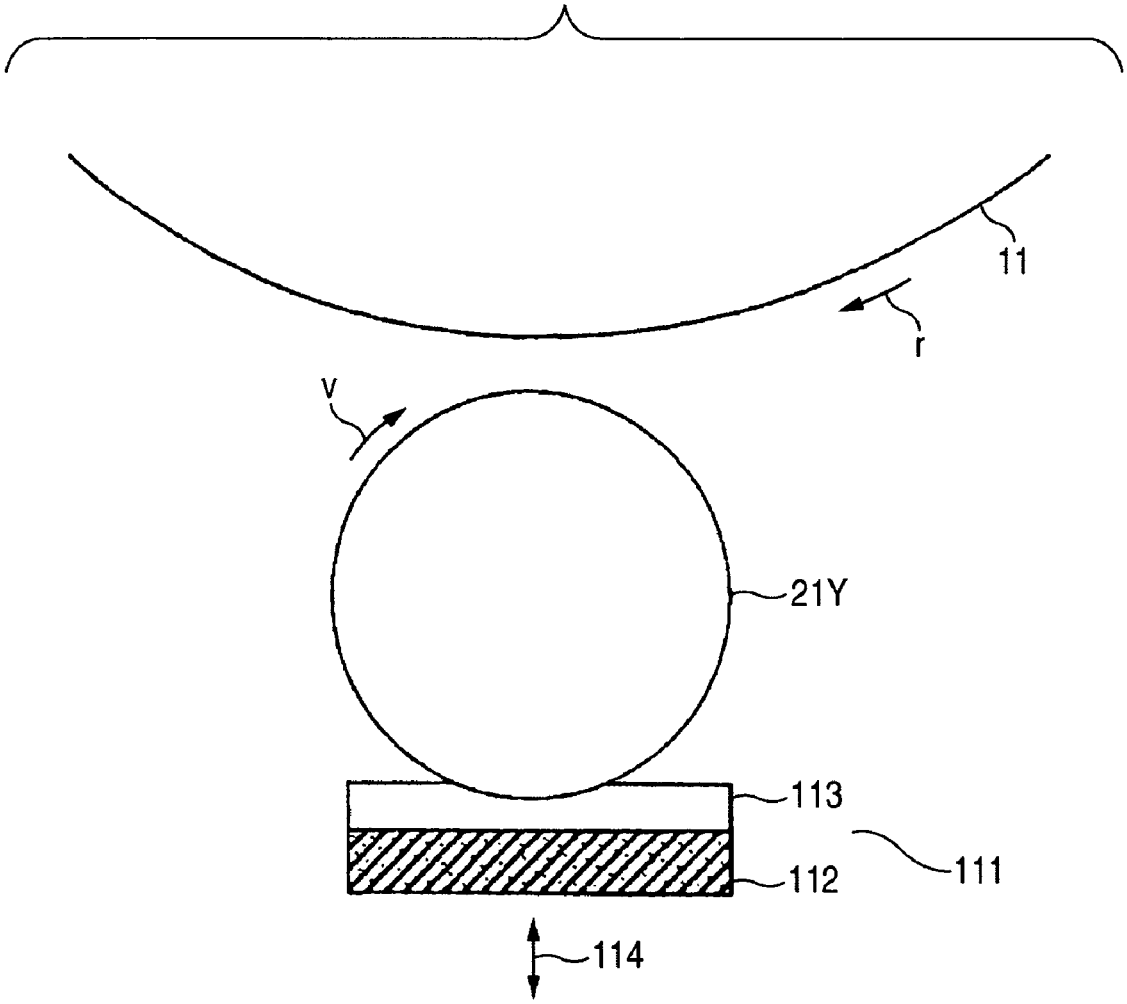
FIG. 12 is a schematic configuration diagram showing a liquid developing agent cleaner of a modified example 8 of the invention.

A modified example 8 shown in FIG. 12 is an example in which a liquid developing agent cleaner 111 is formed by providing a support plate 112 made of a soft elastic body with an elastic flat plate 113 made of urethane rubber etc. and is abutted on the lower end of a squeeze roller 21Y. The liquid developing agent cleaner 111 can separably make contact with the squeeze roller 21Y by a driving device (not shown) and at the time of a stop of the squeeze roller 21Y, the liquid developing agent cleaner 111 is separated and a situation in which a liquid developing agent gathered in the lower end of the squeeze roller 21Y dries and the liquid developing agent cleaner 111 sticks to the squeeze roller 21Y is prevented.

Figure 13:
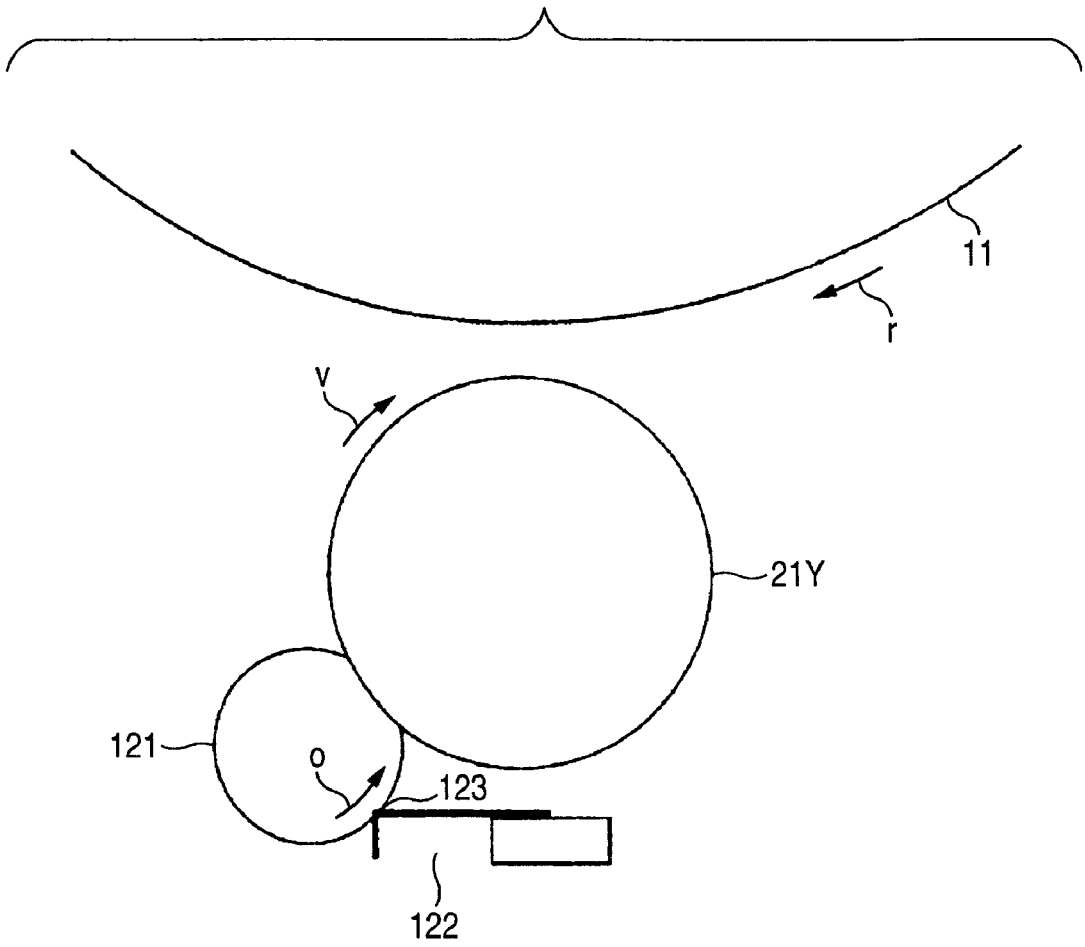
FIG. 13 is a schematic configuration diagram showing a liquid developing agent cleaner of a modified example 9 of the invention.

A modified example 9 shown in FIG. 13 is an example in which an elastic roller which is made of a conductive urethane rubber etc. with $10^{11}$ Ωcm or less and rotates in a direction of arrow o is abutted on a squeeze roller 21Y as a liquid developing agent cleaner 121. A voltage for sucking toner particles is applied to the liquid developing agent cleaner 121 by a power source (not shown) and a liquid developing agent of a surface of the squeeze roller 21Y can be removed more surely. Further, a folded part 123 of a cleaning blade 122 made of an elastic metal plate in which the top is folded abuts on the liquid developing agent cleaner 121 and a liquid developing agent of a surface of the liquid developing agent cleaner 121 is removed.

Further, in the embodiment or the modified examples described above, for example, each of the liquid developing agent cleaners may make contact with the movable body only at the time of movement of the movable body and be separated at the time of a stop of the movable body. By such a configuration, particularly in the case of no use for the long term, there is no fear that the liquid developing agent cleaner sticks to the movable body and a mark of abutment on the liquid developing agent cleaner is left. Also, in the embodiment or the modified examples, for example, it may be configured so that a voltage for sucking a solid component in a liquid developing agent is applied to each of the liquid developing agent cleaners. By such a configuration, the liquid developing agent of a surface of the movable body can be removed more surely.

Further, as long as the movable body transports the liquid developing agent, the movable body is not limited to the squeeze roller or the cleaning roller, etc. and shapes of the movable body may be a belt shape etc.

What is claimed is:

1. A wet type image formation apparatus comprising:

an image carrier;

a developing device forming a visible image on the image carrier by applying a liquid developing agent having a carrier solvent and a solid component to an electrostatic latent image formed on the image carrier;

a squeeze member being movable in contact with the liquid developing agent in order to remove a portion of the carrier solvent from the visible image;

a liquid developing agent cleaner having a plate-shaped elastic body including an edge, a first part having a first curvature radius and a second part being adjacent to the first part, the second part having a second curvature radius smaller than the first curvature radius of the first part, the liquid developing agent cleaner removing the liquid developing agent from a surface of the squeeze member by bringing the first part not including the edge of the plate-shaped elastic body into pressure contact with the squeeze member; and a transfer device transferring the visible image on the image carrier after passing through the squeeze member to a transfer material.

2. A wet type image formation apparatus comprising:

an image carrier;

a developing device forming a visible image on the image carrier by applying a liquid developing agent having a carrier solvent and a solid component to an electrostatic latent image formed on the image carrier;

a squeeze member being movable in contact with the liquid developing agent in order to remove a portion of the carrier solvent from the visible image;

a liquid developing agent cleaner having a plate-shaped elastic body having a plane and an edge, the liquid developing agent cleaner removing the liquid developing agent from a surface of the squeeze member by bringing the plane not including the edge of the plate-shaped elastic body into pressure contact with the squeeze member; and a transfer device transferring the visible image on the image carrier after passing through the squeeze member to a transfer material.

3. A wet type image formation apparatus comprising:

an image carrier;

a developing device forming a visible image on the image carrier by applying a liquid developing agent having a carrier solvent and a solid component to an electrostatic latent image formed on the image carrier;

a squeeze member being movable in contact with the liquid developing agent in order to remove a portion of the carrier solvent from the visible image;

a liquid developing agent cleaner having an edge and a plate-shaped elastic body having a curved surface with a curvature radius 100 times or more an average particle diameter of the solid component, the liquid developing agent cleaner removing the liquid developing agent from a surface of the squeeze member by bringing the curved surface not including the edge of the plate-shaped elastic body into pressure contact with the squeeze member; and a transfer device transferring the visible image on the image carrier after passing through the squeeze member to a transfer material.

4. A wet type image formation apparatus comprising:

an image carrier;

a developing device forming a visible image on the image carrier by applying a liquid developing agent having a carrier solvent and a solid component to an electrostatic latent image formed on the image carrier;

a squeeze member being movable in contact with the liquid developing agent in order to remove a portion of the carrier solvent from the visible image;

a liquid developing agent cleaner having an edge and joining an elastic body chip to a support plate, the liquid developing agent cleaner removing the liquid developing agent from a surface of the squeeze member by bringing the elastic body chip not including the edge into pressure contact with the squeeze member; and a transfer device transferring the visible image on the image carrier after passing through the squeeze member to a transfer material.

5. A wet type image formation apparatus comprising:

an image carrier;

a developing device forming a visible image on the image carrier by applying a liquid developing agent having a carrier solvent and a solid component to an electrostatic latent image formed on the image carrier;

a squeeze member being movable in contact with the liquid developing agent in order to remove a portion of the carrier solvent from the visible image;

a liquid developing agent cleaner having an edge and an elastic body roller, the liquid developing agent cleaner removing the liquid developing agent from a surface of the squeeze member by bringing the elastic body roller not including the edge into pressure contact with the squeeze member; and a transfer device transferring the visible image on the image carrier after passing through the squeeze member to a transfer material.

6. A wet type image formation apparatus according to claim 1, wherein the liquid developing agent cleaner attachably and detachably moves from the squeeze member.

7. A wet type image formation apparatus according to claim 2, wherein the liquid developing agent cleaner attachably and detachably moves from the squeeze member.

8. A wet type image formation apparatus according to claim 3, wherein the liquid developing agent cleaner attachably and detachably moves from the squeeze member.

9. A wet type image formation apparatus according to claim 1, wherein the liquid developing agent cleaner has a conductive material with $10^{11}$ Ωcm or less, and wherein a voltage for sucking the solid component of the liquid developing agent is applied to the conductive material of the liquid developing agent cleaner.

10. A wet type image formation apparatus according to claim 2, wherein the liquid developing agent cleaner has a conductive material with $10^{11}$ Ωcm or less, and wherein a voltage for sucking the solid component of the liquid developing agent is applied to the conductive material of the liquid developing agent cleaner.

11. A wet type image formation apparatus according to claim 3, wherein the liquid developing agent cleaner has a conductive material with $10^{11}$ Ωcm or less, and wherein a voltage for sucking the solid component of the liquid developing agent is applied to the conductive material of the liquid developing agent cleaner.

12. A wet type image formation apparatus according to claim 1, wherein a free end of the liquid developing agent cleaner is located on an upstream side from a mounting end of the liquid developing agent cleaner when viewed from a direction of movement of a surface of the squeeze member.

13. A wet type image formation apparatus according to claim 2, wherein a free end of the liquid developing agent cleaner is located on an upstream side from a mounting end of the liquid developing agent cleaner when viewed from a direction of movement of a surface of the squeeze member.

14. A wet type image formation apparatus according to claim 1, wherein a region of the plate-shaped elastic body where the squeeze member is contact with is configured by a rubber material with a rubber hardness of 20 to 80.

15. A wet type image formation apparatus according to claim 1, wherein a region of the plate-shaped elastic body where the squeeze member is in contact with is configured by an elastic polymeric material.

16. A wet type image formation apparatus according to claim 1, wherein the plate-shaped elastic body is configured by a metal plate with a thickness of 0.05 mm to 0.3 mm.

17. A wet type image formation apparatus according to claim 1, wherein a contact pressure of the plate-shaped elastic body with the squeeze member is 10 g/cm to 400 g/cm per length of a direction perpendicular to a direction of movement of the squeeze member.

18. A liquid developing agent cleaner for removing a liquid developing agent from a surface of a liquid developing agent carrier by making contact with the liquid developing agent carrier for carrying the liquid developing agent having a carrier solvent and a solid component, the liquid developing agent cleaner comprising:

a plate-shaped elastic body having:

an edge;

a first part having a first curvature radius; and a second part being adjacent to the first part and having a second curvature radius smaller than the first curvature radius of the first part, wherein the first part not including the edge of the plate-shaped elastic body is brought into pressure contact with the liquid developing agent carrier.

* * * * *